US011192745B2

(12) United States Patent
Matsumoto

(10) Patent No.: US 11,192,745 B2
(45) Date of Patent: Dec. 7, 2021

(54) IMAGE READING APPARATUS AND IMAGE FORMING APPARATUS INCLUDING THE IMAGE READING APPARATUS

(71) Applicant: CANON KABUSHIKI KAISHA, Tokyo (JP)

(72) Inventor: Akira Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/801,767

(22) Filed: Feb. 26, 2020

(65) Prior Publication Data

US 2020/0270090 A1 Aug. 27, 2020

(30) Foreign Application Priority Data

Feb. 27, 2019 (JP) ..... JP2019-035009

(51) Int. Cl.
*B65H 31/20* (2006.01)
*B65H 1/04* (2006.01)

(52) U.S. Cl.
CPC ..... *B65H 31/20* (2013.01); *B65H 1/04* (2013.01); *B65H 2405/1116* (2013.01); *B65H 2405/11162* (2013.01)

(58) Field of Classification Search
CPC ..... B65H 31/22; B65H 31/20; B65H 1/04
See application file for complete search history.

(56) References Cited

U.S. PATENT DOCUMENTS

2014/0103603 A1* 4/2014 Horita ..... B65H 5/062 271/171
2014/0319760 A1* 10/2014 Komuro ..... B65H 1/266 271/223
2020/0216283 A1* 7/2020 Lo ..... B65H 29/52

FOREIGN PATENT DOCUMENTS

JP 2015-067448 A 4/2015

* cited by examiner

*Primary Examiner* — Howard J Sanders
(74) *Attorney, Agent, or Firm* — Venable LLP

(57) ABSTRACT

An image reading apparatus includes an original tray, an original feeding portion, an original reading portion, an original discharging portion, an original discharge tray, an extension tray, and a rotation guide. A stacking surface of the original discharge tray is provided with an opening through which the rotation guide is capable of passing when the rotation guide rotates from a first position to a second position. In a state in which the extension tray is held at a pulled-out position, the rotation guide is rotatable relative to the extension tray from the first position toward the second position. In a state in which the extension tray is held at an accommodated position, the rotation guide is rotatable from the first position toward the second position by passing through the opening.

16 Claims, 8 Drawing Sheets

(a)

(b)

(a)

(b)

IMAGE READING APPARATUS AND IMAGE FORMING APPARATUS INCLUDING THE IMAGE READING APPARATUS

FIELD OF THE INVENTION AND RELATED ART

The present invention relates to an image reading apparatus and an image forming apparatus including the image reading apparatus.

In Japanese Laid-Open Patent Application (JP-A) 2015-67448, a multi-function machine which includes a printer portion provided at a lower portion and a scanner portion provided at an upper portion and which discharges a recording sheet, on which an image is formed in the printer portion, to a discharge tray is proposed. In the discharge tray, an extension tray is movably supported, and a rotation tray is rotatably supported by the extension tray. The extension tray is movable between a first position where the extension tray is accommodated in the discharge T and a second position where the extension tray is pulled out of a front edge of the discharge tray.

The rotation tray is capable of being positioned between an accommodated state in which the rotation tray is accommodated in a recessed portion of the extension tray and an inclined state in which the rotation tray is rotated from the accommodated state, and by positioning the rotation tray in the inclined state, a discharged recording sheet is prevented from falling from the extension tray. When the extension tray is in the first position, an upper portion of the rotation tray in the accommodated state is covered with an upper plate of the discharge tray, so that the rotation tray cannot be opened from the accommodated state to the inclined state. Further, only after the extension tray is pulled out to the second position, the rotation tray can be opened from the accommodated state to the inclined state. Incidentally, in recent years, an image forming apparatus such as a multi-function machine capable of using recording sheets of a plurality of sizes has been desired. However, the rotation tray disclosed in JP-A 2015-67448 can be opened from the accommodated state to the inclined state only in the state in which the extension tray is pulled out to the second position, so that the rotation tray disclosed in JP-A 2015-67448 does not meet the recording sheets of the plurality of sizes.

SUMMARY OF THE INVENTION

According to an aspect of the present invention, there is provided an image reading apparatus comprising: an original tray on which an original is stacked; a feeding portion configured to feed the original set on the original tray; a reading portion configured to read an image of the original fed by the feeding portion; a discharging portion configured to discharge the original read by the reading portion; an original discharge tray configured to stack the original discharged by the discharging portion; an extension tray movable between an accommodated position where the extension tray is accommodated in the original discharge tray and a pulled-out position where the extension tray is pulled out of the original discharge tray in an original discharge direction in which the original is discharged by the discharging portion; and a rotation guide which is rotatably supported by the extension tray and which is rotatable between a first position where the rotation guide extends along a stacking surface of the extension tray and a second position where the rotation guide extends upward with movement of the original in the original discharge direction and causes a load force to act on the original toward an upstream side of the original discharge direction when the original is contacted thereto, wherein the stacking surface of the original discharge tray is provided with an opening through which the rotation guide is capable of passing when the rotation guide rotates from the first position to the second position, wherein in a state in which the extension tray is held at the pulled-out position, the rotation guide is rotatable relative to the extension tray from the first position toward the second position, and wherein in a state in which the extension tray is held at the accommodated position, the rotation guide is rotatable from the first position toward the second position by passing through the opening.

Further features of the present invention will become apparent from the following description of exemplary embodiments with reference to the attached drawings.

Figure 6:
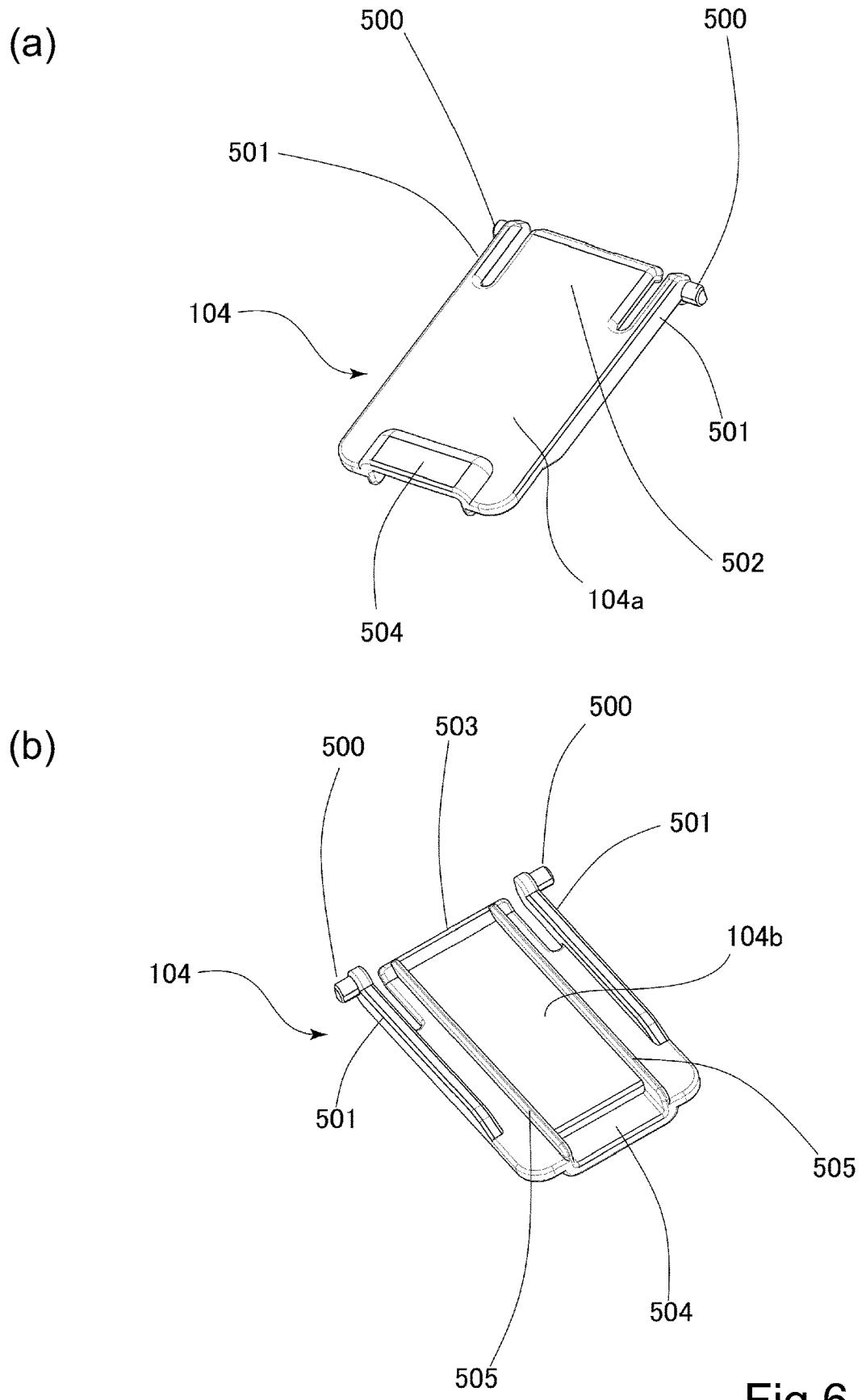

Part (a) of FIG. 6 is a top perspective view of a rotation guide, and part (b) of FIG. 6 is a bottom perspective view of the rotation guide.

Figure 7:
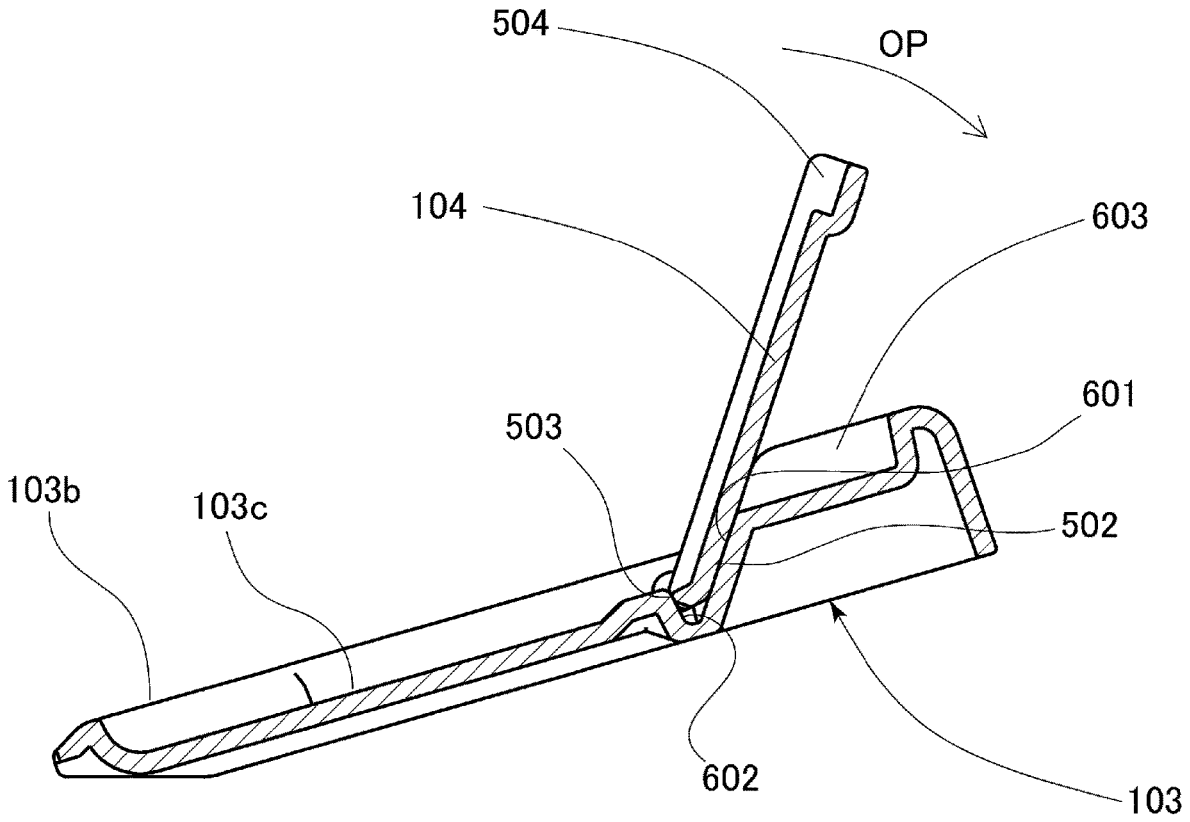

FIG. 7 is a sectional view showing a supporting structure of the rotation guide being in an open position.

Figure 8:
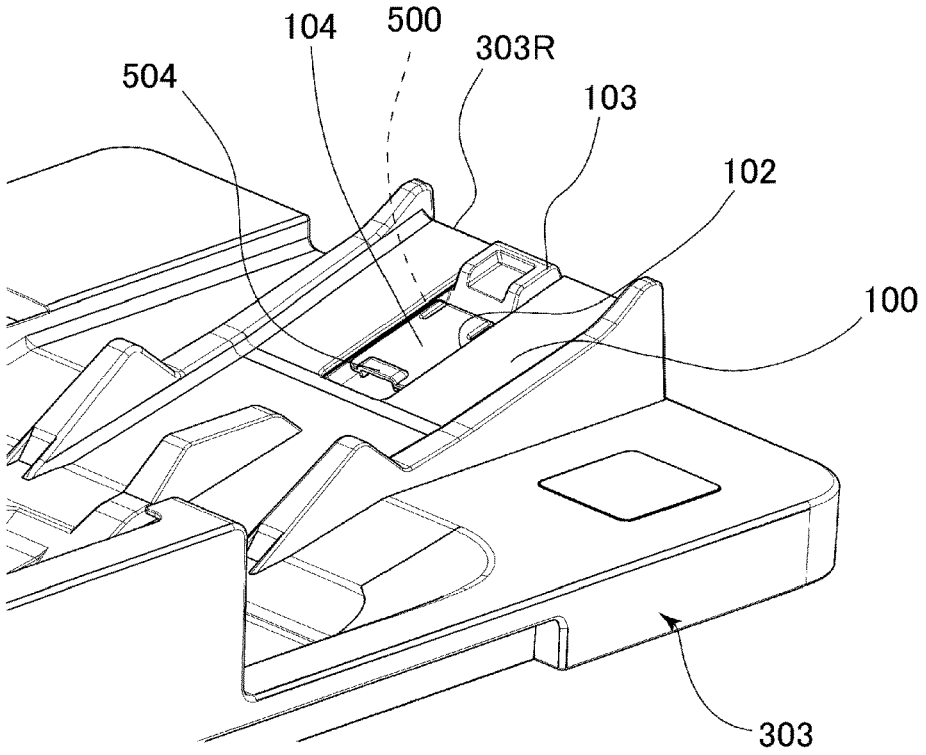
Figure 8:
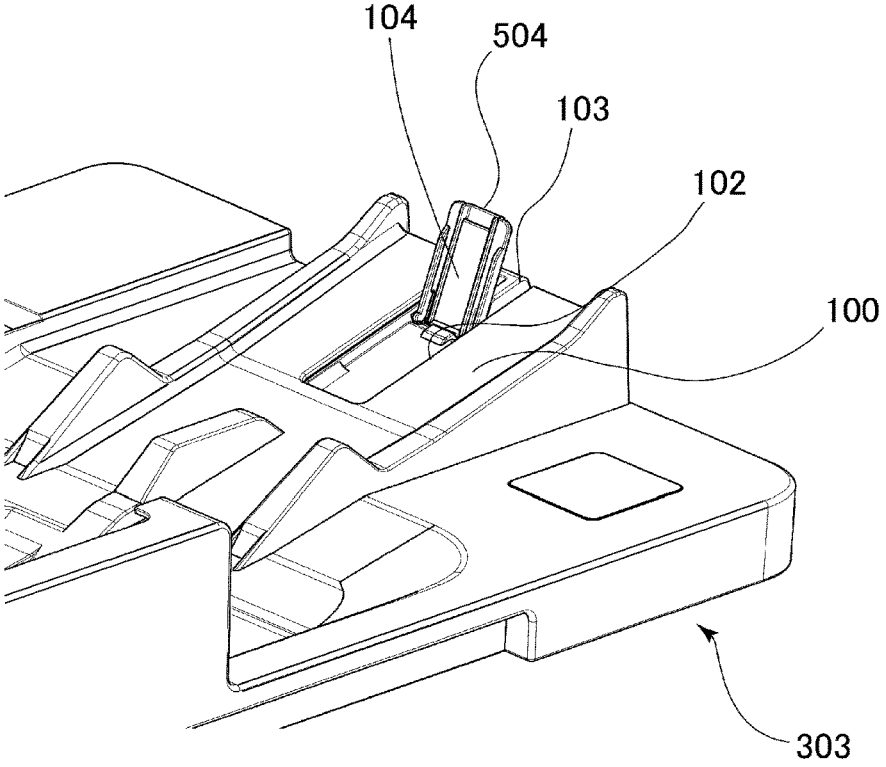

Part (a) of FIG. 8 is a perspective view showing a state in which the extension tray is in an accommodated position and the rotation guide is in a closed position, and part (b) of FIG. 8 is a perspective view showing a state in which the extension tray is in the accommodated position and the rotation guide is in an open position.

Figure 9:
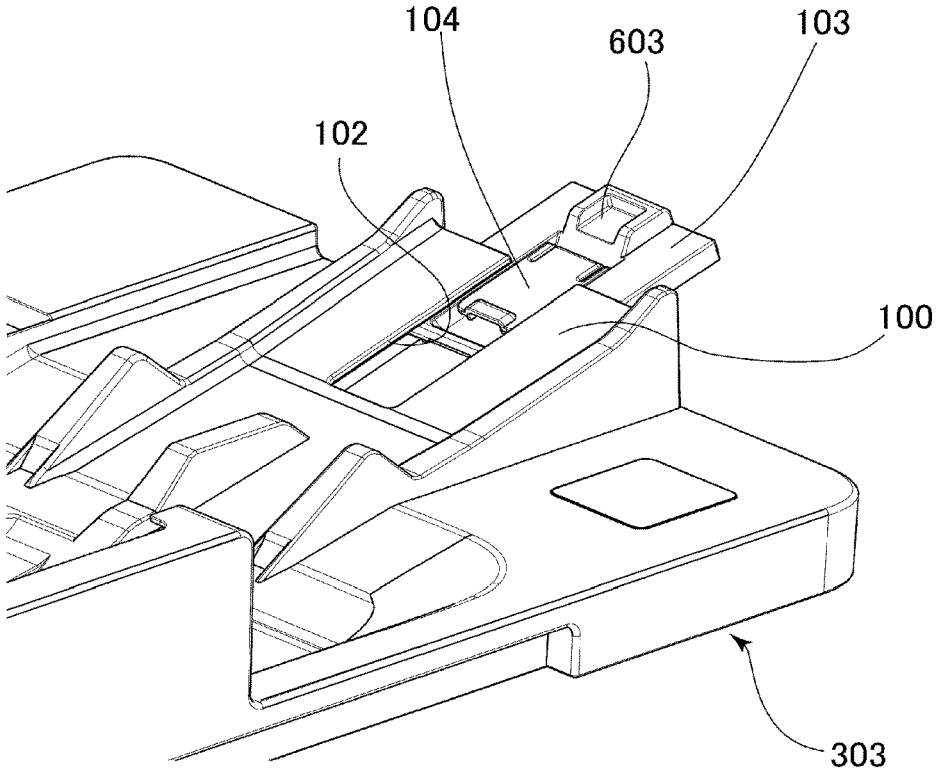
Figure 9:
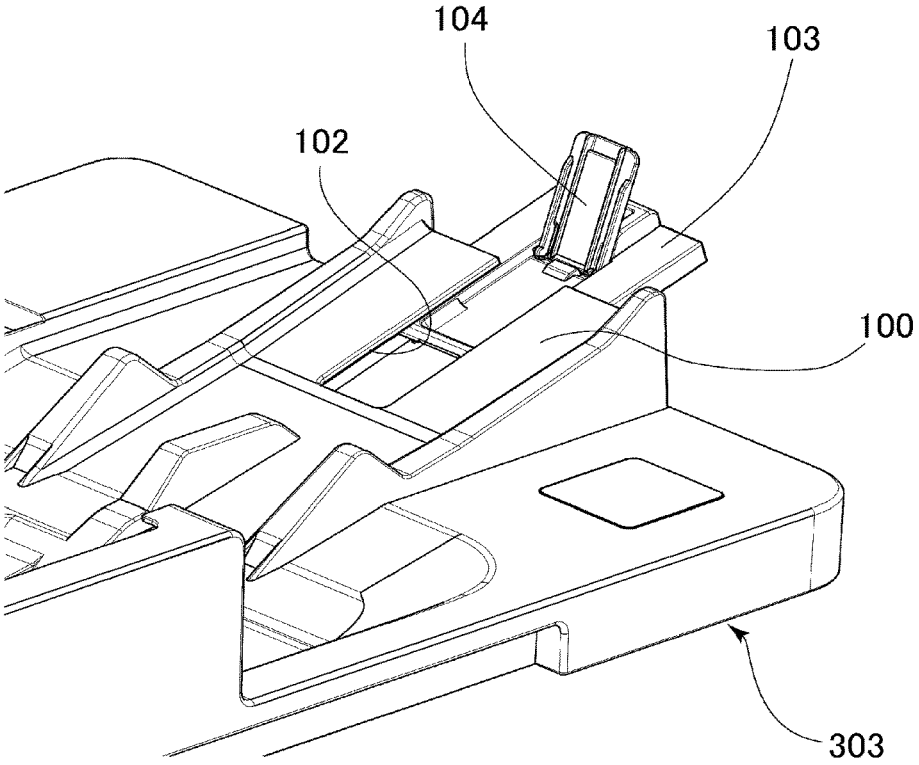

Part (a) of FIG. 9 is a perspective view showing a state in which the extension tray is in a pulled-out position and the rotation guide is in a closed position, and part (b) of FIG. 9 is a perspective view showing a state in which the extension tray is in the pulled-out position and the rotation guide is in an open position.

DESCRIPTION OF EMBODIMENTS

[General Structure]

Figure 1:
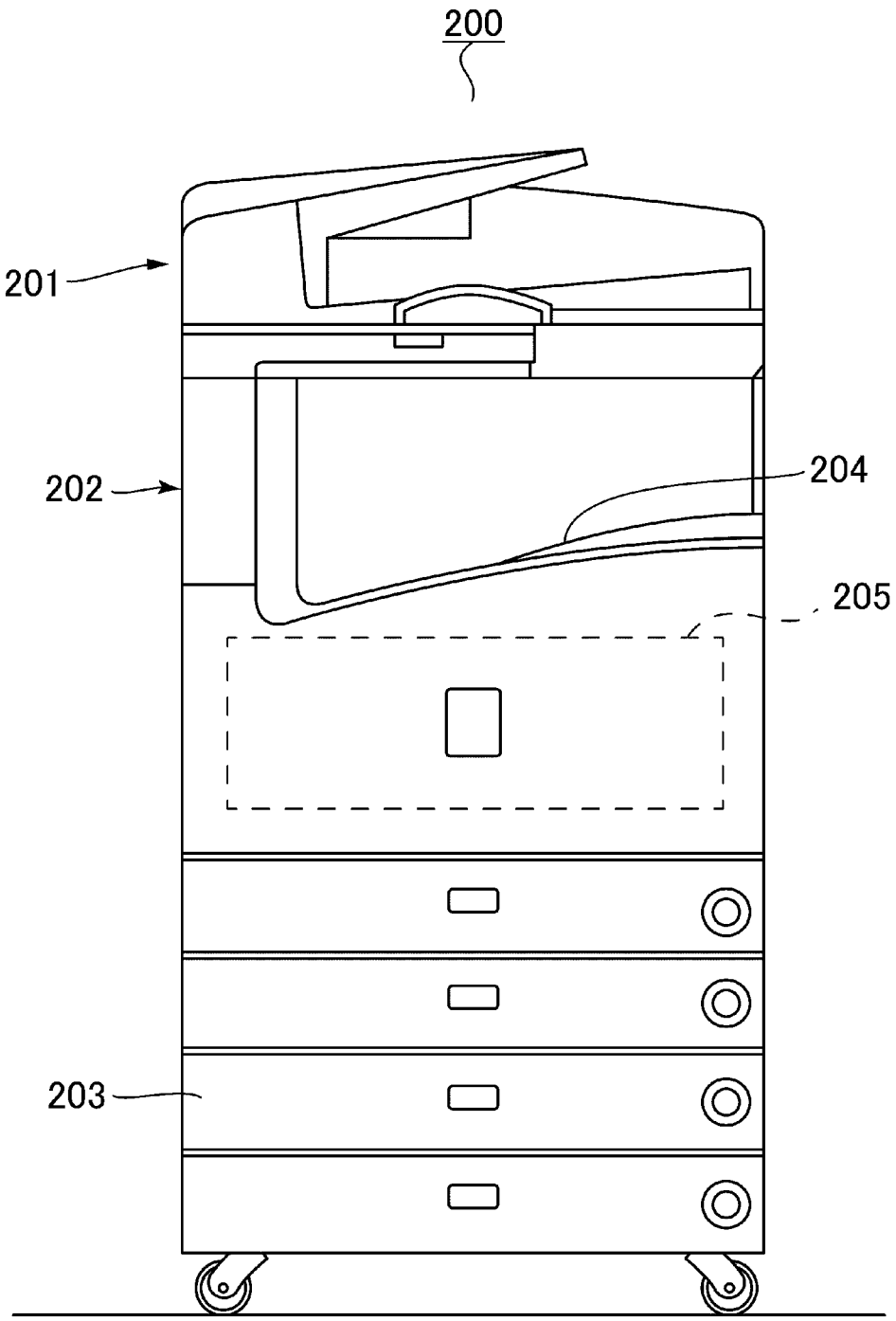
FIG. 1 is a front view showing an entirety of a printer in an embodiment.

A printer 200 as an image forming apparatus according to an embodiment of the present invention is a laser beam printer of an electrophotographic type. The printer 200 includes, as shown in FIG. 1, a printer main assembly 202 and an image reading apparatus 201 mounted on the printer main assembly 202.

The printer main assembly 202 includes an image forming portion 205 for forming an image on a sheet and a cassette 203 for accommodating sheets to be fed to the image forming portion 205, and above the image forming portion 205, a discharge tray 204 on which the sheets are to be discharged is provided. The sheet accommodated in the cassette 203 is fed by an unshown feeding roller or the like. The image forming portion 205 includes an unshown laser writing portion, electrophotographic process portion, fixing portion and the like, and forms the image on the sheet, fed from the cassette 203, in accordance with a conventional known electrophotographic type (process). The sheet on which the image is formed by the image forming portion 205 is a sheet other than an original of which image is read by the image reading apparatus 201.

[Image Reading Apparatus]

Figure 2:
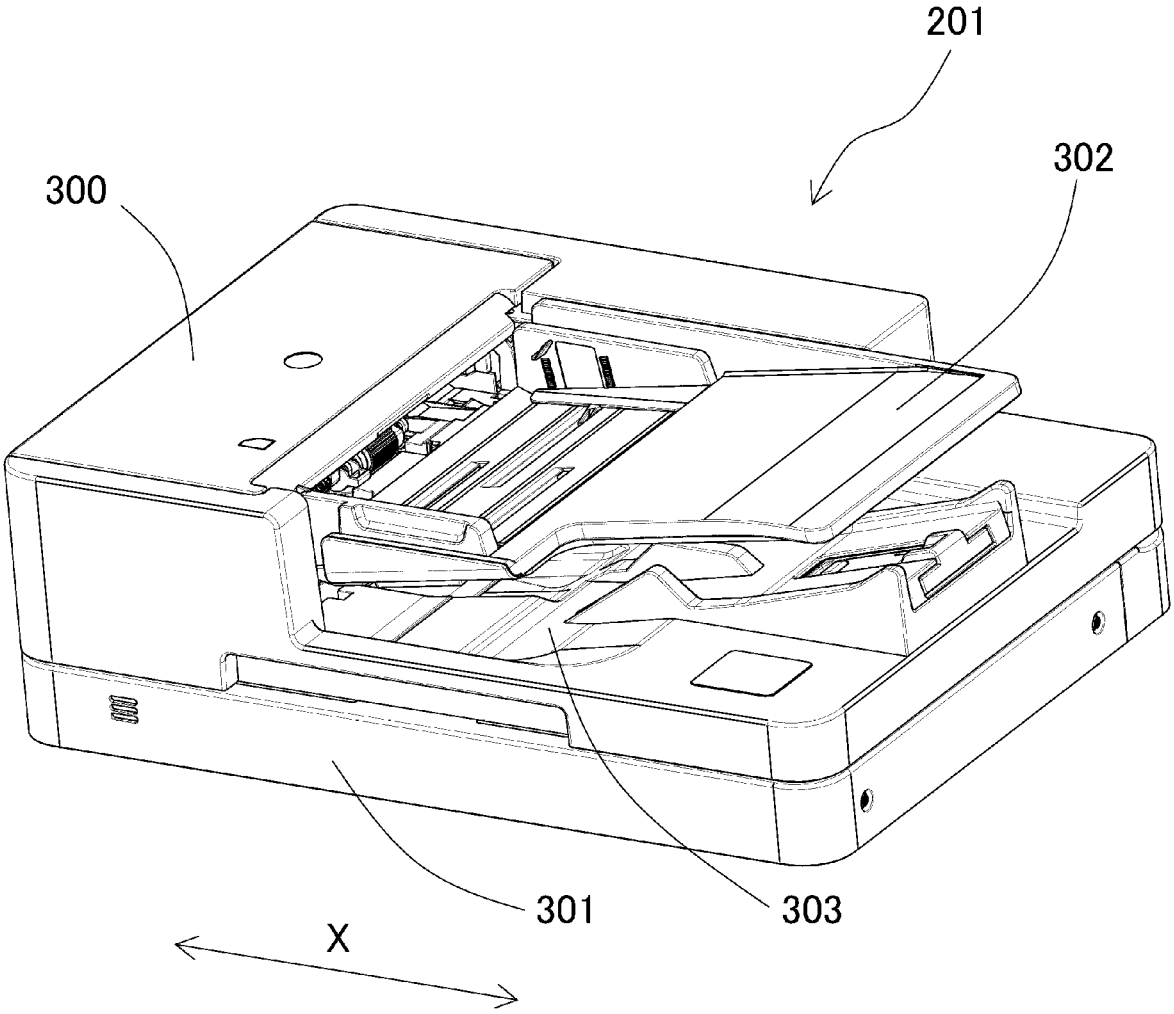
FIG. 2 is a perspective view showing an image reading apparatus.
Figure 3:
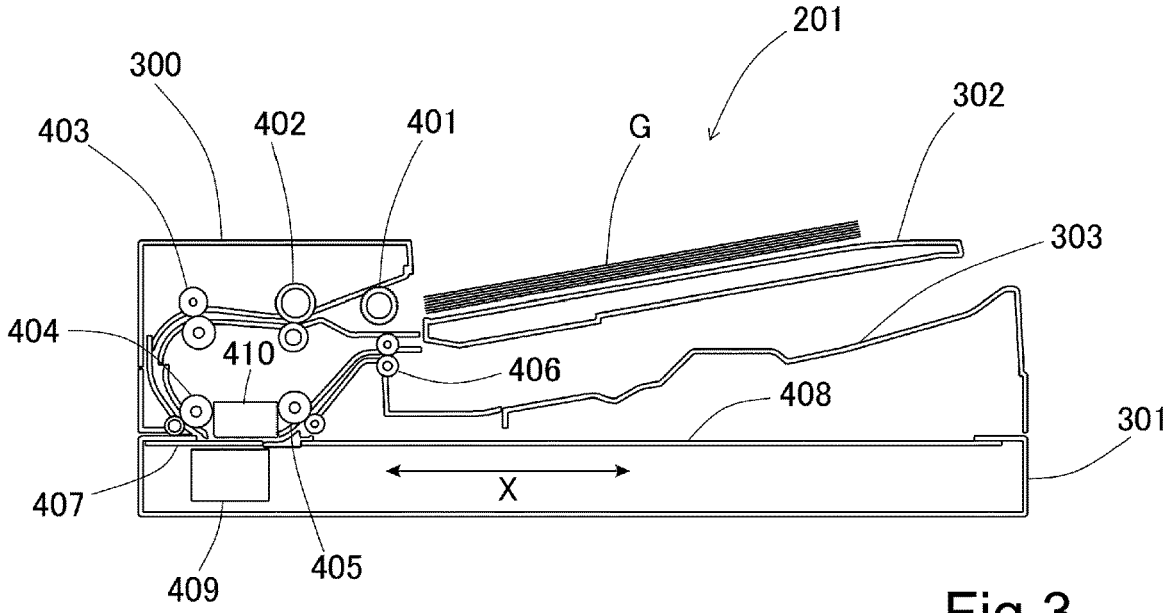
FIG. 3 is a sectional view showing the image reading apparatus.

Next, the image reading apparatus 201 will be described in detail. The image reading apparatus 201 includes, as shown in FIGS. 2 and 3, an automatic document (original) feeder (ADF) 300 for feeding an original G stacked on an original tray 302 and for discharging the original G onto an original discharge tray 303. The image reading apparatus 201 further includes a reading user 301 for reading the (image of) original G fed by the ADF 300. Incidentally, in this embodiment, the sheet includes a recording material on which the image is formed by the image forming portion 205 and the original of which image is read by the image reading apparatus 201. The original may be white paper or one with image(s) on one side (surface) or both sides (surfaces).

The ADF 300 includes, as shown in FIG. 3, a pick-up roller 401, a separation roller pair 402, a plurality of feeding roller pairs 403, 404 and 405, a discharging roller pair 406, and a second reading portion 410 provided opposed to a platen glass 407.

The reading user 301 includes the platen glass 407, an original supporting (platen) glass 408, and a first reading portion 409, and the first reading portion 409 as a reading portion is movable in a sub-scan direction. Each of the first reading portion 409 and the second reading portion 410 incorporates unshown light source, photoelectric conversion element and the like, and as the photoelectric conversion element, a CCD sensor or a CMOS sensor is applicable. Light emitted from the light source is reflected by the original G, and reflected light from the original G enters the photoelectric conversion element. The photoelectric conversion element subjects the reflected light from the original G to photoelectric conversion, and thus can obtain an image of the original G as image information.

The platen glass 407 and the original supporting glass 408 are formed of a transparent member such as a glass permitting light transmission. Further, an image reading form of the original G fed by the ADF 300 is referred to as a skimming-through reading, and an image reading form of the original G in which the original is positioned on the original supporting glass 408 and the image of the original is read while moving the first reading portion 409 in the sub-scan direction is referred to as fixed reading.

In the case of the fixed reading, a user opens the ADF 300 upward relative to the reading user 301 and stacks (places) the original on the original supporting glass 408. Then, the user operates an unshown operating panel, so that the fixed reading by the image reading apparatus 201 is started. When the fixed reading is started, the first reading portion 409 is moved in a sub-scan direction X, so that an image of the original on the original supporting glass 408 is read.

In the case of the skimming-through reading, the user stacks the original G on the original tray 302 and then operates the operating panel, thus starting the skimming-through reading. At this time, the first reading portion 409 carries out reading of the image is a state in which the first reading portion 409 is at rest at a position below the platen glass 407. The original G stacked on the original tray 302 is fed by the pick-up roller 401 which is a sheet (paper) feeding portion and then is separated one by one by the separation roller pair 402. Then, the original G is fed to the platen glass 407 by the feeding roller pairs 403 and 404.

The original G is subjected to reading of a second surface (back surface) image thereof by the second reading portion 410 while being subjected to reading of a first surface (front surface) image thereof by the first reading portion 409 through the platen glass 407. The original G subjected to the reading of the first and second surface images thereof is fed to the discharging roller pair 406 by the feeding roller pair 405, and is discharged to an outside of the printer by the discharging roller pair 406 as a discharging portion. The original G discharged to the outside of the printer is stacked on the original discharge tray 303. Incidentally, the original G discharged to the outside of the printer by the discharging roller pair 406 is discharged at a speed faster than 340 mm/s or more and 650 mm/s or less, for example. The second portion 410 may be disposed at any position of a feeding passage formed in the ADF 300, and may also be omitted.

[Structure of Sheet Discharge Portion]

Figure 4:
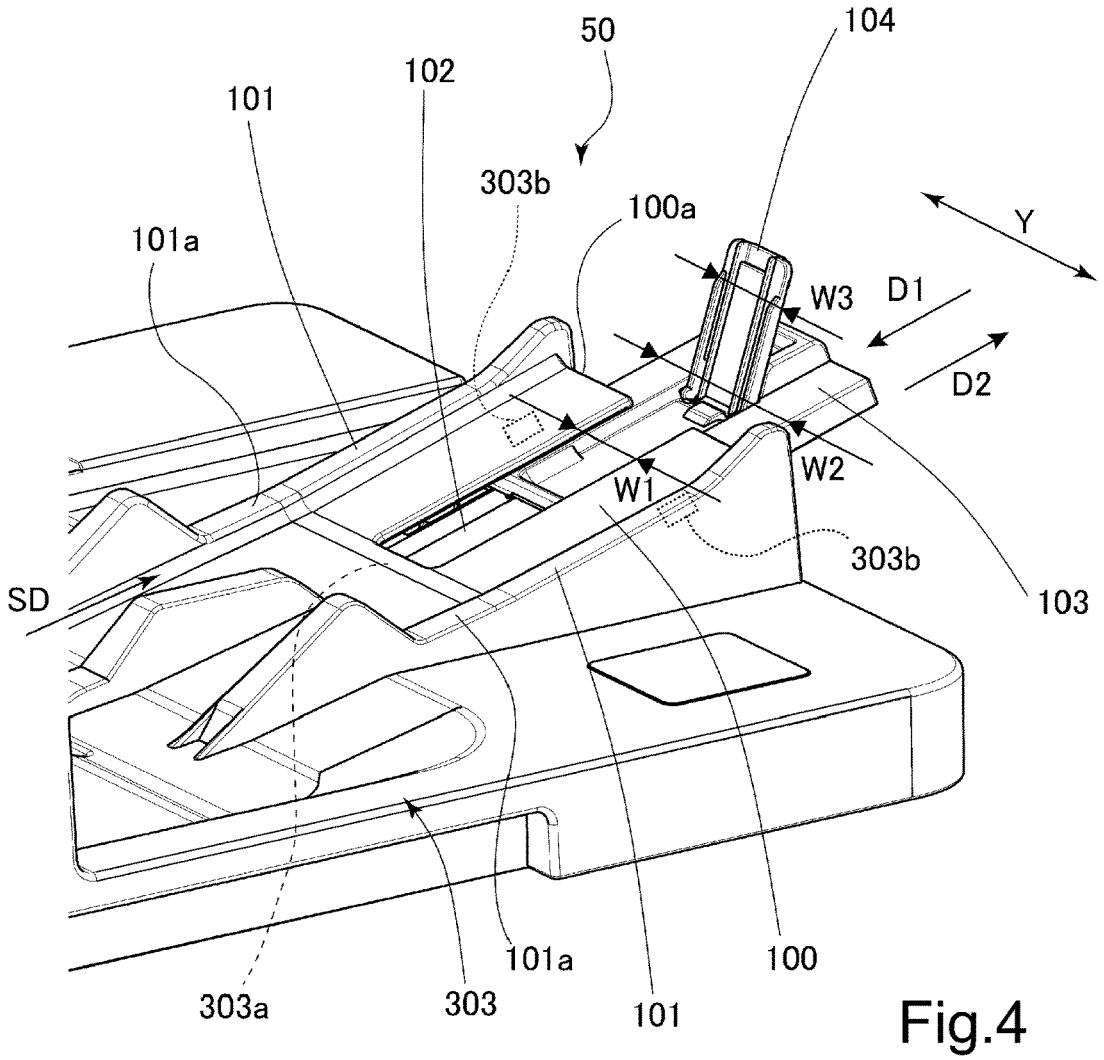
FIG. 4 is a perspective view showing a sheet discharge portion.

Next, a structure of a sheet (paper) discharge portion 50 including the original discharge tray 303 will be described while making reference to FIGS. 4 to 7. The sheet discharge portion 50 includes, as shown in FIG. 4, the discharging roller pair 406 (FIG. 3), the original discharge tray 303 for supporting the original discharged in an original discharge direction SD by the discharging roller pair 406, an extension tray 103, and a rotation guide 104.

The original discharge tray 303 includes a stacking surface 100 and a pair of stacking ribs 101 which are provided at opposite end portions of the stacking surface 100 with respect to a widthwise direction Y and which project upward from the stacking surface. With respect to the widthwise direction Y, the original having a size smaller than a width of the stacking surface 100 is stacked on the stacking surface 100. With respect to the widthwise direction Y, the original having a size larger than the width of the stacking surface 100 is stacked on the pair of stacking ribs. The stacking surface 100 is provided with an opening 102 described later, and therefore the user is capable of taking the original out of the stacking surface 100 by putting user's hand into the opening 102. Further, the original stacked on the pair of stacking ribs 101 can be easily taken out by putting user's hand into a space between the original and upper surfaces 101*a* since the upper surfaces 101*a* of the stacking ribs 101 have a shape recessed downward.

The extension tray 103 is supported by the original discharge tray 303 so as to be capable of being accommodated and pulled out, and is capable of supporting the original. The extension tray 103 is movable between an accommodated position (position shown in part (a) of FIG. 8) where the extension tray 103 is accommodated in the original discharge tray 303 and a pulled-out position (position shown in part (b) of FIG. 8) where the extension tray 103 is pulled out of the original discharge tray 303.

Figure 5:
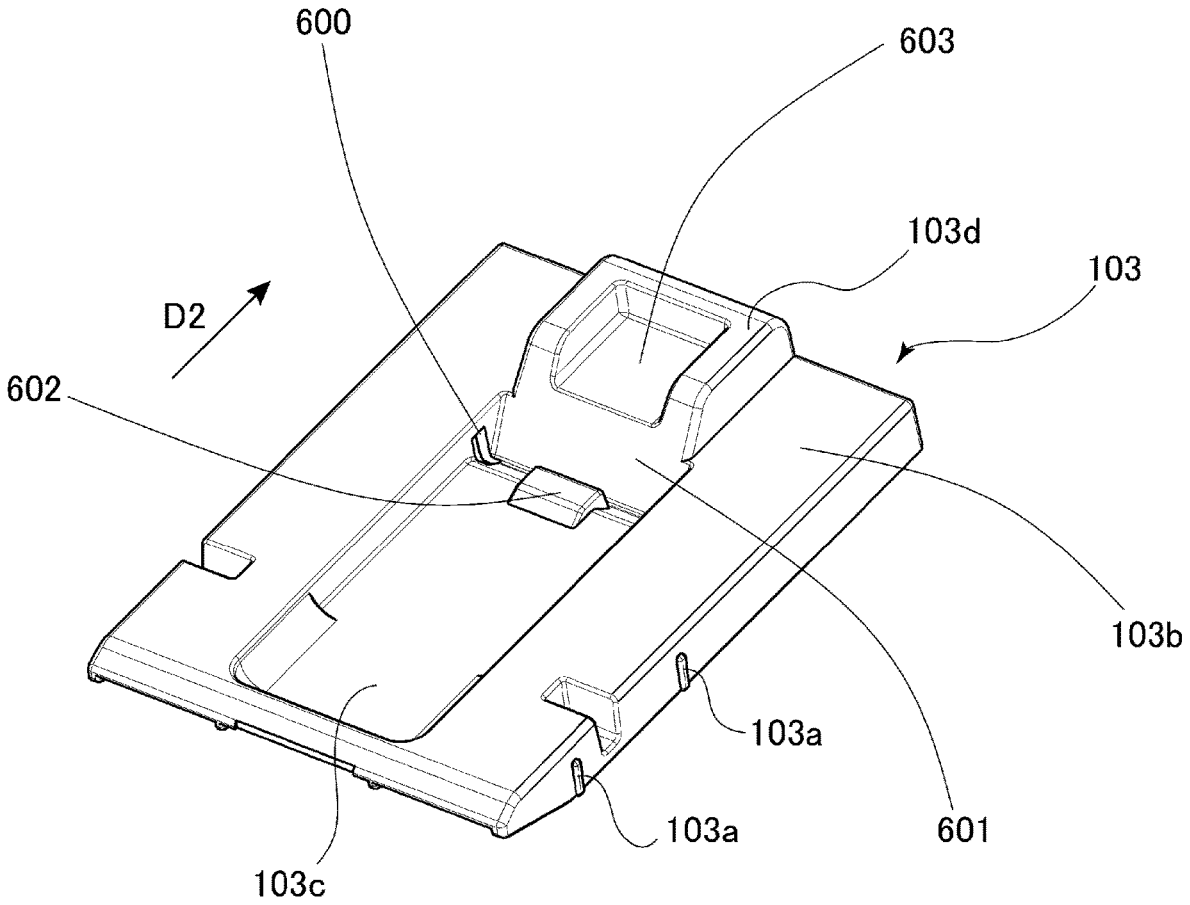
FIG. 5 is a perspective view showing an extension tray.

The extension tray 103 abuts against an abutment portion 303*a* provided in the original discharge tray 303 and thus is positioned in the accommodated position and the abutment portion 303*a* restricts movement of the extension tray 103 in an accommodating direction D1. Further, the extension tray 103 includes, as shown in FIGS. 4 and 5, ribs 103*a* and 103*a* on both side surfaces, and the ribs 103*a* and 103*a* engage with engaging portions 303*b* and 303*b* provided on the original discharge tray 303, and thus the extension tray 103 is positioned at the pulled-out position. The engaging portions 303*b* and 303*b* as restricting portions restrict movement of the extension tray 103 in a pulling-out direction D2.

Incidentally, a structure for holding the extension tray 103 at the accommodated position or the pulled-out position is not limited thereto, and the extension tray 103 may also be held by snap-fitting or the like. The extension tray 103 may also be constituted so as to be held at not only the two positions consisting of the accommodated position and the pulled-out position but also one or more position between the accommodated position and the pulled-out position.

The extension tray 103 includes, as shown in FIG. 5, a base surface 103*a* extending along the pulling-out direction D2, a recessed portion 103*c* recessed downward from the base surface 103*a*, and a projected portion 103*d* provided downstream of the recessed portion 103*c* with respect to the original discharge direction. On the recessed portion 103*c*, a pair of bearing portions 600 and an abutment surface 602 provided upstream of the bearing portions 600 with respect to the original discharge direction. The abutment surface 602 is formed on a bottom of the recessed portion 103*c*. The projected portion 103*d* projects upward from the base surface 103*b*, and includes an abutment surface 601 formed on an upstream side with respect to the original discharge direction and a finger hooking portion 603 which is operable by the user when the user moves the extension tray 103. The finger hooking portion 603 as the operating portion has a recessed shape.

The rotation guide 104 includes, as shown in FIG. 4 and parts (a) and (b) of FIG. 6, a pair of rotation shafts 500 provided at one end portion and a pair of arm portions 501 which is provided with the rotation shafts 500 at one ends thereof and which is formed in an elongated shape. By elastically deforming the pair of arm portions 501 inward, the rotation shafts 500 can be easily assembled with the bearing portions 600 of the extension tray 103. As a result, the rotation guide 104 is openably supported by the extension tray 103 between a closed position (position shown in part (a) of FIG. 8) which is a first position and an open position (position shown in part (b) of FIG. 8) which is a second position about the rotation shafts 500 and as one end portions relative to the extension tray 103.

The rotation guide 104 extends along the stacking surface of the extension tray 103 when the rotation guide 104 is in the closed position, and is accommodated in the recessed portion 103*c* of the extension tray 103. Further, the rotation guide 104 extends upward in the original discharge direction when the rotation guide 104 is in the open position, and restricts movement of the discharged sheet toward a downstream side with respect to the original discharge direction. That is, the original discharged on the discharge portion (device) 50 contacts the rotation guide 104 positioned in the open position, so that a load force acts on the original toward an upstream side with respect to the original discharge direction. The discharged original is decelerated or is pushed back toward the upstream side with respect to the original discharge direction as the case may be. As a result, the original is aligned, so that falling of the original from the discharge device 50 is reduced.

When the rotation guide 104 is in the closed position, an upper surface of the rotation guide 104 is a first surface 104*a*, and a surface opposite from the first surface 104*a* is a second surface 104*b*. At this time, at the other end portion opposite from the rotation shafts 500, the finger hooking portion 504 as an open/close operating portion operable by the user when the user opens the rotation guide 104. On one end portion (rotation shaft 500) side of the first surface 104*a*, a contact surface 502 contactable to the abutment surface 601 of the extension tray 103 is formed.

Further, on the second surface 104*b* of the rotation guide 104, a pair of ribs 505 and 505 on which the discharged original is slidable is formed, and on one end portion (rotation shaft 500) side of the second surface 104*b*, a contact surface 503 contactable to the abutment surface 602 of the extension tray 103 is formed.

[Supporting Structure of Rotation Guide in Open Position]

A supporting structure of the rotation guide 104 in the open position will be described in detail with reference to FIG. 7. As shown in FIG. 7, when the rotation guide 104 is opened from the closed position to the open position, the contact surface 502 of the rotation guide 104 abuts against the abutment surface 601 of the extension tray 103. As a result, an attitude of the rotation guide 104 can be maintained in the open position.

Further, when the rotation guide 104 is opened to the open position, the contact surface 503 of the rotation guide 104 abuts against the abutment surface 602 of the extension tray 103. That is, the extension tray 103 has the abutment surface 602 as a first contact portion contactable to the contact surface 503 formed on an upstream surface, with respect to the original discharge direction, of the rotation guide 104 located in the open position. Further, the extension tray 103 has the abutment surface 601 as a second contact portion contactable to the contact surface 502 formed on a downstream surface, with respect to the original discharge direction, of the rotation guide 104 located in the open position.

Thus, the rotation guide 104 contacts the extension tray 103 at two positions on the upstream side and the downstream side with respect to the original discharge direction, and therefore, a force acting on the rotation guide 104 can be distributed, so that breakage of the rotation guide 104 can be prevented. For example, during the assembling of the rotation guide 104, even in the case where a large force acts on the rotation guide 104 in an open direction OP, a degree of stress concentration on the arm portions 501 of the rotation guide 104 can be made small, so that breakage of the arm portions 501 can be prevented.

Specifically, the rotation guide 104 is formed of PC+ABS resin material possessing features of both the PC resin material and the ABS resin material. For example, in a constitution in which the rotation guide 104 abuts against the extension tray 103 only at one position when the rotation guide 104 is in the open position, the arm portion 501 has been broken when a load of 2-3 kgf acts on the rotation guide 104 in the open direction OP. On the other hand, in a constitution in which the rotation guide 104 abuts against the extension tray 103 at two positions when the rotation guide 104 is in the open position, the arm portion 501 is not broken even when a load of 10 kgf acts on the rotation guide 104 in the open direction OP. Thus, it is possible to provide the rotation guide 104 which is not readily broken even in the case where the user erroneously applies a large force to the rotation guide 104.

[Opening]

Next, the opening 102 formed in the original discharge tray 303 will be described. As shown in FIG. 4, the stacking surface 100 of the original discharge tray 303 is provided with the opening 102, and the opening 102 extends along the accommodating direction D1 of the extension tray 103 to the abutment portion 303*a* from a downstream end 100*a* of the stacking surface 100 with respect to the original discharge direction. Further, a width W1 of the opening 102 with respect to the widthwise direction Y is smaller than a width W2 of the extension tray 103 with respect to the widthwise direction Y and is larger than a width W3 of the rotation guide 104 with respect to the widthwise direction Y. Thus, the opening 102 is configured so that the rotation guide 104 movable from the closed position to the open position is capable of pass through the opening 102.

[Operations of Extension Tray and Rotation Guide]

Next, operations of the extension tray 103 and the rotation guide 104 will be described in detail. Further, as shown in parts (a) and (b) of FIG. 8, the operation of the rotation guide 104 in the case where the extension tray 103 is used in the accommodated position will be described.

In the case where the rotation guide 104 is used in the open position, the user hooks his (her) finger(s) on the finger hooking portion 504 of the rotation guide 104 positioned in the closed position and moves the rotation guide 104 to the open position. At this time, one end portion when the rotation shafts 500 of the rotation guide 104 are provided is positioned upstream of a downstream end 303R of the original discharge tray 303 with respect to the original discharge direction, but the rotation guide 104 is capable of moving from the closed position to the open position through the opening 102.

In this embodiment, in a state in which the extension tray 103 is in the accommodated position and the rotation guide 104 is in the open position, an A4R-size original may suitably be used. Here, "R" of the A4R-size shows the case where the original is set on the original tray 302 in a state in which of a long side and a short side of the original, the short side extends in a direction perpendicular to the original discharge direction. That is, in the state shown in part (b) of FIG. 8, by the rotation guide 104, a stacking property of the A4R-size original with respect to the original discharge direction can be effectively improved.

Next, as shown in parts (a) and (b) of FIG. 9, the operation of the rotation guide 104 in the case where the extension tray 103 is used in the pulled-out position will be described. First, in the case where the rotation guide 104 is positioned in the accommodated position, the user pulls out the extension tray 103 to the pulled-out position by hooking his (her) finger(s) on the finger hooking portion 603 of the extension tray 103. Then, the user hooks his (her) finger(s) on the finger hooking portion 504 of the rotation guide 104 positioned in the closed position and moves the rotation guide 104 to the open position. At this time, the rotation guide 104 passes through the opening 102.

In this embodiment, in a state in which the extension tray 103 is in the pulled-out position and the rotation guide 104 is in the open position, an LGL (legal)-size original larger than the A4R-size original may suitably be used. That is, in the state shown in part (b) of FIG. 9, by the rotation guide 104, a stacking property of the LGL-size original with respect to the original discharge direction can be effectively improved.

Incidentally, in the above description, the operation in which the rotation guide 104 is opened when the extension tray 103 is in the accommodated position or the pulled-out position was described, but the present invention is not limited thereto. That is, in this embodiment, the opening 102 is formed over a region from the downstream end 100*a* of the staking surface 100 of the original discharge tray 303 to the abutment portion 303*a*. For this reason, the rotation guide 104 can be opened from the closed position to the open position even at any position between the accommodated position and the pulled-out position of the extension tray 103. That is, the opening 102 is configured so that the rotation guide 104 movable from the closed position to the open position is capable of passing through the opening 102 when the extension tray 103 is positioned on a side upstream of the pulled-out position with respect to the pulling-out direction.

As described above, in this embodiment, not only when the extension tray 103 is in the pulled-out position but also when the extension tray 103 is in a position other than the pulled-out position, the rotation guide 104 can be moved from the closed position to the open position. For this reason, correspondingly to not only a single-size original but also originals of a plurality of sizes, the rotation guide 104 is usable at a plurality of open positions. For this reason, an alignment property and a stacking property of the originals of the plurality of sizes can be effectively improved.

In recent years, a discharge speed of the original by the discharging roller pair 406 becomes faster in order to meet user's demands for higher productivity. For example, even when the original is discharged at the discharge speed faster than 340 mm/s and slower than 650 mm/s, by the rotation guide 104 disposed at an appropriate position depending on the original size, it is possible to effectively improve the alignment property and the stacking property of the original.

Further, when the extension tray 103 is in the accommodated position, the rotation guide 104 is opened to the open position and then can be moved to the pulled-out position without being closed. For this reason, an operation order of the extension tray 103 and the rotation guide 104 by the user is not limited, so that usability can be improved.

Further, the rotation guide 104 being in the open position contacts the abutment surfaces 601 and 602 of the extension tray 103 at two positions, and therefore, the force acting on the rotation guide 104 can be distributed, so that breakage of the rotation guide 104 can be reduced. As a result, in the case where the rotation guide 104 is positioned in the open position and then the extension tray 103 is moved from the accommodated position to the pulled-out position as described above, the user may only be required to pull the finger hooking portion 504. Thus, even when the user performs the operation in which the load is exerted on the rotation guide 104, it is possible to prevent the breakage of the rotation guide 104 and to improve the usability.

Further, the finger hooking portion 603 provided on the extension tray 103 is disposed at a position where the user is capable of operating the finger hooking portion 603 even when the rotation guide 104 is in the open position, and therefore the user can operate the finger hooking portion 603 of the extension tray 103.

Incidentally, the opening 102 in this embodiment is constituted by a cut-away portion formed in a U-shape, but the shape of the opening 102 is not limited. Further, the shape of the abutment surfaces 601 and 602 formed on the extension tray 103 is also not limited, and the abutment surfaces 601 and 602 may also be formed with ribs or the like.

Further, in either of the constitutions described above, description was made by using the printer 200 of the electrophotographic type, but the present invention is not limited thereto. For example, the present invention is also applicable to an image forming apparatus of an ink jet type in which an image is formed on a sheet by ejecting an ink liquid through nozzles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-035009 filed on Feb. 27, 2019, which is hereby incorporated by reference herein in its entirety.

What is claimed is:

1. An image reading apparatus comprising:

an original tray on which an original is stacked;

a feeding portion configured to feed the original set on said original tray;

a reading portion configured to read an image of the original fed by said feeding portion;

a discharging portion configured to discharge the original read by said reading portion;

an original discharge tray on which the original discharged by said discharging portion is stacked;

an extension tray movable between an accommodated position where said extension tray is accommodated in said original discharge tray and a pulled-out position where said extension tray is pulled out of said original discharge tray toward a downstream of an original discharge direction in which the original is discharged by said discharging portion; and a rotation guide which is rotatably supported by said extension tray and which is rotatable between a first position where said rotation guide is folded so as to overlap said extension tray and a second position where said rotation guide rises above said extension tray, wherein said extension tray includes a supporting portion for rotatably supporting said rotation guide, and a first contact portion and a second contact portion for contacting said rotation guide, wherein when said rotation guide is positioned in the second position, said rotation guide contacts said first contact portion of said extension tray and contacts said second contact portion of said extension tray on the downstream of said first contact portion with respect to the original discharge direction, and wherein said extension tray includes a base surface extending along a pulling-out direction, a recessed portion which is recessed downward relative to said base surface and where said rotation guide being in the first position is accommodated, and a projected portion which not only is provided downstream of said recessed portion with respect to the original discharge direction but also projects upward relative to said base surface and on which said second contact portion is formed.

2. An image reading apparatus according to claim 1, wherein a stacking surface of said original discharge tray is provided with an opening through which said rotation guide is capable of passing when said rotation guide rotates from the first position to the second position, wherein in a state in which said extension tray is held in the pulled out position, said rotation guide is rotatable relative to said extension tray from the first position toward the second position, and wherein in a state in which said extension tray is held in the accommodated position, said rotation guide is rotatable from the first position toward the second position by passing through said opening.

3. An image reading apparatus according to claim 2, wherein in a state in which said rotation guide is in the second position, said extension tray is movable between the accommodated position and the pulled-out position.

4. An image reading apparatus according to claim 2, wherein a width of the opening with respect to a widthwise direction perpendicular to the original discharge direction is smaller than a width of said extension tray with respect to the widthwise direction and is larger than a width of said rotation guide with respect to the widthwise direction.

5. An image reading apparatus according to claim 1, wherein said original discharge tray includes an accommodation restriction portion configured to restrict movement of said extension tray in an accommodating direction when said extension tray is positioned in the accommodated position.

6. An image reading apparatus according to claim 1, wherein said rotation guide includes a first contact surface provided at one end thereof and a second contact surface formed on an upper surface thereof in the first position of said rotation guide, and wherein when said rotation guide is positioned in the second position, the first contact surface contacts said first contact portion of said extension tray and the second contact surface contacts said second contact portion of said extension tray.

7. An image reading apparatus according to claim 1, wherein said first contact portion is formed on a bottom of said recessed portion.

8. An image reading apparatus according to claim 7, wherein an angle formed between a surface, of said rotating guide in the second position, against which the original discharged from said discharging portion abuts and said base surface in the accommodated position or the pulled-out position of said extension tray is larger than 90 degrees.

9. An image reading apparatus according to claim 1, wherein said projected portion includes an operating portion which is operable when said extension tray is moved.

10. An image reading apparatus according to claim 1, wherein said rotation guide is rotatably supported at one end portion thereof relative to said extension tray between the first position and the second position, and wherein said rotation guide includes an open/close operating portion, at the other end portion opposite from said one end portion, operable when said rotation guide is opened.

11. An image reading apparatus according to claim 1, wherein said rotation guide restricts movement of the original, discharged on said original discharge tray, to a downstream side with respect to the original discharge direction.

12. An image reading apparatus according to claim 1, wherein said discharging portion discharges the original at a speed faster than 340 mm/s and slower than 650 mm/s.

13. An image reading apparatus according to claim 1, wherein the first contact portion includes a surface facing a downstream side with respect to the original discharge direction, and wherein a second contact portion includes a surface facing an upstream side with respect to the original discharge direction.

14. An image forming apparatus comprising:

an original tray on which an original is stacked;

a feeding portion configured to feed the original set on said original tray;

a reading portion configured to read an image of the original fed by said feeding portion;

a discharging portion configured to discharge the original read by said reading portion;

an original discharge tray on which the original discharged by said discharging portion is stacked;

an extension tray movable between an accommodated position where said extension tray is accommodated in said original discharge tray and a pulled-out position where said extension tray is pulled out of said original discharge tray toward a downstream of an original discharge direction in which the original is discharged by said discharging portion;

a rotation guide which is rotatably supported by said extension tray and which is rotatable between a first position where said rotation guide is folded so as to overlap said extension tray and a second position where said rotation guide rises above said extension tray; and an image forming portion configured to form an image on a sheet other than an original of which image is read by said image reading apparatus, wherein said extension tray includes a supporting portion for rotatably supporting said rotation guide, and a first contact portion and a second contact portion for contacting said rotation guide, wherein when said rotation guide is positioned in the second position, said rotation guide contacts said first contact portion of said extension tray and contacts said second contact portion of said extension tray on the downstream of said first contact portion with respect to the original discharge direction, and wherein said extension tray includes a base surface extending along a pulling-out direction, a recessed portion which is recessed downward relative to said base surface and where said rotation guide being in the first position is accommodated, and a projected portion which not only is provided downstream of said recessed portion with respect to the original discharge direction but also projects upward relative to said base surface and on which said second contact portion is formed.

15. An image forming apparatus according to claim 14, wherein a stacking surface of said original discharge tray is provided with an opening through which said rotation guide is capable of passing when said rotation guide rotates from the first position to the second position, wherein in a state in which said extension tray is held in the pulled out position, said rotation guide is rotatable relative to said extension tray from the first position toward the second position, and wherein in a state in which said extension tray is held in the accommodated position, said rotation guide is rotatable from the first position toward the second position by passing through said opening.

16. An image forming apparatus according to claim 14, wherein said rotation guide includes a first contact surface provided at one end thereof and a second contact surface formed on an upper surface thereof in the first position of said rotation guide, and wherein when said rotation guide is positioned in the second position, the first contact surface contacts said first contact portion of said extension tray and the second contact surface contacts said second contact portion of said extension tray.

* * * * *